US008220806B2

(12) United States Patent
Neudeck

(10) Patent No.: US 8,220,806 B2
(45) Date of Patent: Jul. 17, 2012

(54) SURFACE MILLING SYSTEM

(76) Inventor: Roger Hartel Neudeck, Ceres, CA (US)

( * ) Notice: Subject to any disclaimer, the term of this patent is extended or adjusted under 35 U.S.C. 154(b) by 496 days.

(21) Appl. No.: 12/353,224

(22) Filed: Jan. 13, 2009

(65) Prior Publication Data

US 2010/0176567 A1 Jul. 15, 2010

(51) Int. Cl.
*B62D 61/06* (2006.01)

(52) U.S. Cl. ..... 280/62; 280/124.113; 299/1.5; 299/39.4

(58) Field of Classification Search ..... 280/62, 280/124.11, 124.12, 124.13, 43.24, 6.156; 299/39.4, 39.1, 39.6, 1.5; 404/72, 75, 84.5, 404/84.1, 114, 118, 120
See application file for complete search history.

(56) References Cited

U.S. PATENT DOCUMENTS

| | | | | |
|---|---|---|---|---|
| 3,806,141 | A * | 4/1974 | Janer | 280/6.156 |
| 4,807,131 | A | 2/1989 | Clegg | |
| 5,046,890 | A | 9/1991 | Dickson | |
| 5,129,803 | A | 7/1992 | Nomura et al. | |
| 5,309,407 | A | 5/1994 | Sehr et al. | |
| 5,352,063 | A * | 10/1994 | Allen et al. | 404/84.1 |
| 5,378,080 | A | 1/1995 | Dickson | |
| 5,393,167 | A | 2/1995 | Fujita et al. | |
| 5,533,790 | A | 7/1996 | Weiland | |
| 5,567,075 | A * | 10/1996 | Allen | 404/84.5 |
| 5,607,205 | A * | 3/1997 | Burdick et al. | 299/1.5 |
| 5,643,047 | A | 7/1997 | Beckett et al. | |
| 5,774,211 | A | 6/1998 | Ohtomo et al. | |
| 5,984,420 | A * | 11/1999 | Murray et al. | 299/1.5 |
| 6,068,060 | A | 5/2000 | Ohtomo et al. | |
| 6,371,566 | B1 | 4/2002 | Haehn | |
| 6,402,252 | B1 | 6/2002 | Dickson | |
| 6,435,283 | B1 | 8/2002 | Ohtomo et al. | |
| 6,540,458 | B1 | 4/2003 | Ponisch | |
| 6,916,070 | B2 | 7/2005 | Sehr | |
| 7,070,244 | B2 | 7/2006 | Fischer et al. | |
| 7,331,636 | B2 * | 2/2008 | Troudt et al. | 299/39.6 |
| 7,570,347 | B2 * | 8/2009 | Ruff et al. | 356/5.01 |
| 7,643,923 | B2 * | 1/2010 | Buehlmann et al. | 701/50 |
| 7,845,878 | B1 * | 12/2010 | Godbersen et al. | 404/72 |
| 7,850,395 | B1 * | 12/2010 | Brenner et al. | 404/75 |
| 7,854,565 | B2 * | 12/2010 | Halonen et al. | 404/75 |
| 2002/0057952 | A1 | 5/2002 | Haferkorn | |

FOREIGN PATENT DOCUMENTS

| | | |
|---|---|---|
| JP | 7-51926 | 2/1995 |
| JP | 8-99209 | 4/1996 |

OTHER PUBLICATIONS

HTC—The All System: Automatic leveling laser system, © 2007, 2 pages.
International Search Report and Written Opinion mailed Sep. 13, 2010.

* cited by examiner

*Primary Examiner* — Hau Phan
(74) *Attorney, Agent, or Firm* — Merchant & Gould P.C.

(57) ABSTRACT

A cart assembly for milling a surface includes a cart having a support frame, a triad of wheel assemblies, and a triad of receivers. The triad of wheel assemblies is disposed on the support frame. Each wheel assembly includes an actuator that selectively extends and retracts a shaft of the wheel assembly to maintain the support frame at a given elevation. The triad of receivers is disposed on the support frame in a generally triangular configuration. The receivers are in electrical communication with the actuators of the wheel assemblies. The cart assembly further includes a milling assembly mounted to the support frame of the cart. The milling assembly includes a grinder adapted to remove material from a surface.

20 Claims, 5 Drawing Sheets

SURFACE MILLING SYSTEM

BACKGROUND

The achievement of a perfectly, or near perfectly, flat surface on a concrete or other hard surface is particularly important from a viewpoint of function and safety in the case of commercial or industrial buildings and from the viewpoint of satisfying minimum floor flatness specifications on new construction projects. In addition, the perfectly, or near perfectly, flat surface may also be important from the viewpoint of aesthetics in the case of diamond polished floors for all types of buildings.

In the case of commercial and industrial buildings, it is important to produce a floor which is significantly flat to enable forklift trucks to pass safely and efficiently over the floor. The significantly flat floor allows forklift trucks to remain sufficiently level even when heavily loaded, so as to avoid spilling loads or hitting pallet racks in a narrow aisleway due to sway of the lift truck mast. In addition, it is often necessary to provide a significantly flat floor (and perhaps also level) for the mounting of certain types of machinery or industrial equipment.

In the case of diamond polished floors it is highly desirable to produce a flat floor at the very beginning of the grinding and polishing process from the standpoint of two different aesthetic considerations. Firstly, when a typical floor grinder is placed and run on a floor which has an inherent wavy or rippled surface, undesirable gouges or coarse scratches can be formed in the low areas between the high points, or ridges, of the waves as the grinder dips into the low areas. Once formed, these pronounced scratches are extremely difficult to remove in subsequent grinding steps. Secondly, unless the waviness is removed and the floor flattened to an adequate extent, the waves will be extremely visible and very unpleasant in appearance once the floor is brought up to a high polish. In such a case, the waves often resemble a badly warped mirror.

Currently, these surface waves can be selectively removed using conventional dual rotating planetor style or fixed rotating spindle type grinders by a combination of methods. These methods include: (1) using a large-headed grinder compared to the wavelength of the ripples; (2) running the grinder only along the center line of the ridges of the waves until they are milled off flush to the surrounding low areas, and (3) using long straight edges to periodically check the progression of the grinding and flattening operation. These methods are difficult since these methods are laborious, labor intensive and time consuming which results in a method that is also costly. The methods to flatten the surface waves become even more difficult as the wavelength of the ripples increases. While it is possible to achieve a fairly flat floor in most cases by means of applying very good techniques, well suited equipment and extremely skilled workmen, most floors are currently produced which are not substantially perfectly flat, just improved somewhat by means of primarily flattening the shorter wavelength ripples.

As diamond polished floors have been gaining considerably in popularity in recent years because they are extremely durable, very cost effective, require very little maintenance, capable of being very attractive, and finally, have a very high "green" rating (i.e., a very small environmental impact), there exists a need for an effective flattening device which is able to do precision quality flattening.

SUMMARY

An aspect of the present disclosure relates to a cart assembly for milling a surface. The cart assembly includes a cart having a support frame, a triad of wheel assemblies, and a triad of receivers. The triad of wheel assemblies is disposed on the support frame. Each wheel assembly includes an actuator that selectively extends and retracts a shaft of the wheel assembly to maintain the support frame at a given elevation. The triad of receivers is disposed on the support frame in a generally triangular configuration. The receivers are in electrical communication with the actuators of the wheel assemblies. The cart assembly further includes a milling assembly mounted to the support frame of the cart. The milling assembly includes a grinder adapted to remove material from a surface.

Another aspect of the present disclosure relates to a walk-behind cart assembly for milling a surface. The walk-behind cart assembly includes a cart having a support frame, a triad of wheel assemblies, a drive motor, and a triad of receivers. The triad of wheel assemblies is disposed on the support frame. Each of the wheel assemblies includes an actuator that selectively extends and retracts a shaft of the wheel assembly to maintain the support frame at a given elevation. The drive motor is engaged to one of the wheel assemblies and is adapted to propel the support frame. The triad of receivers is disposed on the support frame. The receivers are in electrical communication with the actuators of the wheel assemblies. The cart assembly further includes a milling assembly mounted to the cart. The milling assembly includes a support enclosure and a grinder mounted within the support enclosure. At least a portion of the support enclosure is adapted for floatable movement relative to the cart.

Another aspect of the present disclosure relates to a surface milling system. The surface milling system includes a datum device that generates a reference plane. The surface milling system further includes a support frame. A grinder is supported by the support frame. At least first, second and third wheels support the support frame. At least first, second and third actuators raise and lower the first, second and third wheels relative to the support frame. The first actuator is adapted to raise and lower the first wheel. The second actuator is adapted to raise and lower the second wheel. The third actuator is adapted to raise and lower the third wheel. A first receiver corresponding to the first actuator detects the reference plane. A second receiver corresponding to the second actuator detects the reference plane. A third receiver corresponding to the third actuator detects the reference plane. Data from the first, second and third receivers is used to control the first, second and third actuators such that the support frame is maintained at a constant position relative to the reference plane even when the support frame moves across a surface of varying elevations.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DRAWINGS

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 1:
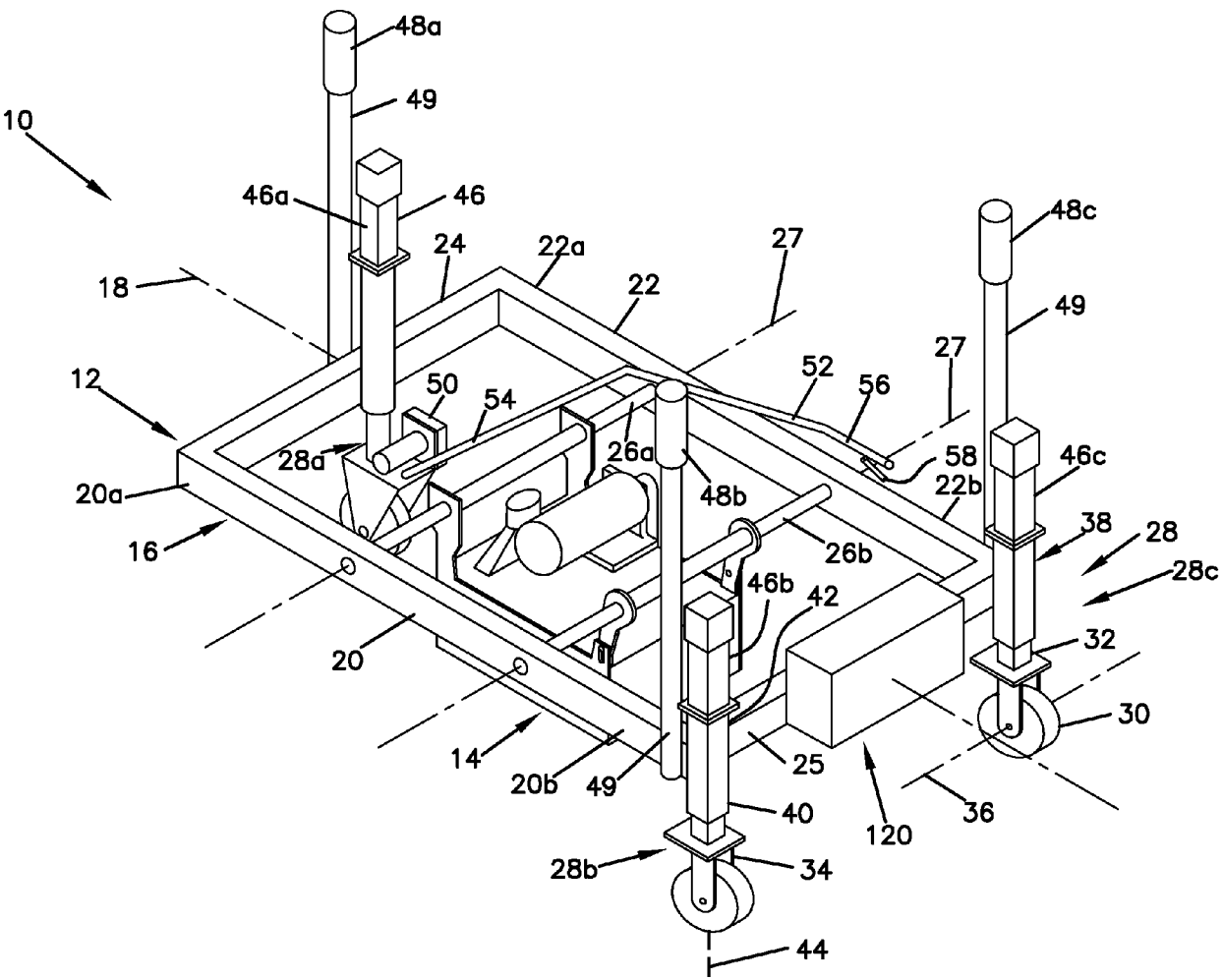
FIG. 1 is a perspective view of a cart assembly shown in a normal operating mode having exemplary features of aspects in accordance with the principles of the present disclosure.

Referring now to FIG. 1, a cart assembly, generally designated 10, which is adapted to mill or grind a surface (e.g., a floor, wall, etc.) as the cart assembly 10 is directed across that surface, is shown. The cart assembly 10 is adapted to flatten the surface such that any unintentional variations in surface flatness are eliminated or significantly reduced. In one aspect of the present disclosure, the cart assembly 10 is adapted for use on a surface prior to diamond polishing that surface.

In one aspect of the present disclosure, the cart assembly 10 is adapted for use in indoor applications. In another aspect of the present disclosure, the cart assembly 10 is adapted for use in outdoor applications. In another aspect of the present disclosure, the cart assembly 10 is adapted to be directed across the surface by an operator that walks behind the cart assembly 10. It will be understood that the term "walk-behind" as used in the disclosure includes walking behind the cart assembly 10 or walking along side the cart assembly 10.

In one aspect of the present disclosure, the cart assembly 10 is compact and is adapted to fit through a standard door opening, which is approximately 36 inches wide. In another aspect of the present disclosure, the cart assembly 10 is lightweight so that it can be used on any conventional elevated floor structure without requiring any special load carrying structures. In one embodiment, the cart assembly 10 is less than or equal to about 700 pounds.

In another aspect of the present disclosure, the cart assembly 10 is electrically powered. This is potentially advantageous for indoor applications as it provides for quite operation and the absence of engine fumes.

The cart assembly 10 includes a cart, generally designated 12, and a milling assembly, generally designated 14. The cart 12 includes a support frame, generally designated 16, that is adapted to support the milling assembly 14. In the depicted embodiment, the support frame 16 is generally rectangular in shape. In other embodiments, the support frame 16 can be configured in other geometrical shapes (e.g., round, square, triangular, etc.).

The support frame 16 defines a central longitudinal axis 18. The support frame 16 of the depicted embodiment includes a first side 20, having a first end 20*a* and an oppositely disposed second end 20*b*, and an oppositely disposed second side 22, having a first end 22*a* and an oppositely disposed second end 22*b*. In the subject embodiment the first and second sides 20, 22 are generally parallel with the central longitudinal axis 18. In the subject embodiment, and by way of example only, the cart 12 has a length of less than about 10 feet. In another embodiment, the cart 12 has a length of less than about 6 feet. In another embodiment, the cart 12 has a length of about 54 inches.

In the depicted embodiment, the support frame 16 further includes a first cross support 24 and an oppositely disposed second cross support 25. The first cross support 24 is engaged with the first end 20*a* of the first side 20 and the first end 22*a* of the second side 22 while the second cross support 25 is engaged with the second end 20*b* of the first side 20 and the second end 22*b* of the second side 22. In the subject embodiment, the first and second cross supports 24, 25 are generally perpendicular to the central longitudinal axis 18. In the subject embodiment, and by way of example only, the cart 12 has a width of less than or equal to about 34 inches. In another embodiment in which a more powerful model is desired, the cart 12 has a width of less than or equal to about 48 inches.

The cart 12 further includes first and second mounting bars 26*a*, 26*b*. In the subject embodiment, the first and second mounting bars 26*a*, 26*b* are substantially similar. Therefore, in the present disclosure, the first and second mounting bars 26*a*, 26*b* will be referred to singularly and collectively as mounting bar(s) 26.

The mounting bars 26 are adapted to engage and support the milling apparatus 14. Each of the mounting bars 26 is generally cylindrical and fixed relative to the frame 16. Each of the mounting bars 26 extends from the first side 20 of the support frame 16 to the second side 22 of the support frame. The mounting bars 26 are disposed generally perpendicularly to the longitudinal axis 18 and define a transverse axis 27 that is generally perpendicular to the longitudinal axis 18.

The cart 12 further includes at least a triad of wheel assemblies, generally designated 28, engaged to the support frame 16. In the subject embodiment, the wheel assemblies 28 are engaged to the support frame 16 in a generally triangular configuration. This triangular configuration includes a first wheel assembly 28*a*, a second wheel assembly 28*b* and a third wheel assembly 28*c* disposed on the cart 12. The first wheel assembly 28*a* is engaged to the first cross support 24 while the second and third wheel assemblies 28*b*, 28*c* are engaged to the second cross support 25. In the depicted embodiment, the first wheel assembly 28*a* is disposed on the first cross support 24 such that it is generally aligned with the central longitudinal axis 18 while the second and third wheel assemblies 28*b*, 28*c* are disposed on the second cross support 25 such that the second wheel assembly 28*b* is adjacent the first side 20 of the support frame 16 and the third wheel assembly 28*c* is adjacent the second side 22.

Each of the wheel assemblies 28 includes a wheel 30 that is engaged to a shaft 32. In the subject embodiment, the shaft 32 is vertical. In the subject embodiment, the wheel 30 is engaged to a bifurcated end 34 of the shaft 32 such that the wheel 30 selectively rotates about an axis 36 of the bifurcated end 34.

The shaft 32 is selectively slidably disposed in a sleeve 38 that is mounted to the support frame 16. In the subject embodiment, the sleeve 38 is fixed relative to the frame 16. The sleeve 38 includes a first axial end 40 and an oppositely disposed second axial end 42 and defines a longitudinal axis 44. In the subject embodiment, the longitudinal axis 44 is vertical. The shaft 32 selectively extends and retracts through the first axial end 40 of the sleeve 38 along the longitudinal axis 44.

The cart 12 further includes at least a triad of actuators 46. In the subject embodiment, the cart 12 includes a first actuator 46*a*, a second actuator 46*b* and a third actuator 46*c*. The first actuator 46*a* is adapted to raise and lower the shaft 32 that is connected to the wheel 30 of the first wheel assembly 28*a*. The second actuator 46*b* is adapted to raise and lower the shaft 32 that is connected to the wheel 30 of the second wheel assembly 28*b*. The third actuator 46*c* is adapted to raise and lower the shaft 32 that is connected to the wheel 30 of the third wheel assembly 28*c*. The actuators 46 are adapted to raise and lower their respective wheels 30 so as to maintain the support frame 16 at a constant elevation. The first, second and third actuators 46*a*, 46*b*, 46*c* function independently from each other but each has the goal of maintaining the portion of the support frame 16 to which they are attached at a desired elevation.

In the subject embodiment, each of the actuators 46 is engaged to the second axial end 42 of the sleeve 38 of the corresponding wheel assembly 28 and is adapted to telescopically slide the shaft 32 along the longitudinal axis 44 relative to the sleeve 38. Each actuator 46 includes a microprocessor that is adapted to control the actuation of the shaft 32. In response to an electrical signal received by the microprocessor, the actuator 46 extends and/or retracts the shaft 32 of the wheel assembly 28. In one embodiment, the microprocessor of the actuator 46 includes a plurality of programmable functions. In the subject embodiment, the actuator 46 is a linear actuator. An exemplary linear actuator that is suitable for use with the cart assembly 10 is a linear actuator manufactured by Exlar Corporation of Chanhassen, Minn. having a model number of TLM30 Linear Actuator.

The cart 12 further includes a triad of receivers 48 engaged to the support frame 16. In the subject embodiment, the triad of receivers 48 is disposed in a generally triangular configuration on the support frame 16. Each of the receivers 48 is adapted to receive/sense/detect a signal, which corresponds to a reference plane, from a transmitter and to communicate a signal to the corresponding actuator 46 to control actuation of the shaft 32 of the corresponding wheel assembly 28.

The receivers 48 are mounted on vertical posts 49 that are fixed to the frame 16. The vertical posts 49 elevate the receivers 48 relative to the frame 16. In one embodiment, the receivers 48 are disposed at an elevation relative to the surface that is in a range of about 5.5 feet to about 7.5 feet. In another embodiment, the receivers 48 are disposed at an elevation relative to the surface that is in a range of about 6 feet to about 7 feet. In another embodiment, the receivers 48 are disposed at an elevation relative to the surface of about 6.5 feet. This elevation reduces the risk of interference (e.g., operator blocking receivers 48) between the transmitter of the signal and the receivers 48. In one embodiment, all of the receivers 48 are set at exactly the same distance above the support frame 16.

The receivers 48 are in data/signal transmitting communication with the actuators 46 of the wheel assemblies 28. In one embodiment, the receivers 48 are in wireless communication with the actuators 46. In another embodiment, the receivers 48 are in wired communication with the actuators 46.

In the subject embodiment, a first receiver 48*a* is disposed on the support frame 16 adjacent the first wheel assembly 28*a* while second and third receivers 48*b*, 48*c* are disposed on the support frame 16 adjacent the second and third wheel assemblies 28*b*, 28*c*, respectively. In another embodiment, the first receiver 48*a* is disposed on the first wheel assembly 28*a* while the second and third receivers 48*b*, 48*c* are disposed on the second and third wheel assemblies 28*b*, 28*c*, respectively.

The cart 12 further includes a drive motor 50 engaged with one of the wheel assemblies 28. The drive motor 50 is adapted to selectively propel the cart assembly 10 by rotating at least one of the wheel assemblies 28. In the subject embodiment, the drive motor 50 is an electric motor that is engaged with the first wheel assembly 28*a*. In one embodiment, the drive motor 50 is engaged with the wheel 30 of the first wheel assembly 28*a* through a chain or belt. In another embodiment, the drive motor 50 is engaged with the wheel 30 such that the drive motor 50 is aligned with the axis 36 of the bifurcated end 34.

At least one of the wheel assemblies 28 is adapted to be steered. In the subject embodiment, the shaft 32 and sleeve 38 of the first wheel assembly 28*a* are cylindrically shaped such that the shaft 32 is rotatable about the longitudinal axis 44 of the sleeve 38.

In one embodiment, the steering of the first wheel assembly 28*a* is effectuated by manual actuation of a tiller arm 52, which is mounted to the first wheel assembly 28*a*. The tiller arm 52 includes a first end portion 54 and an oppositely disposed second end portion 56. In the subject embodiment, the first end portion 54 of the tiller arm 56 is mounted to the bifurcated end 34 of the first wheel assembly 28*a*.

The second end portion 56 extends outwardly in a generally radial direction from the bifurcated end 34 such that the second end portion 56 is accessible by an operator standing behind the second cross support 25. In another embodiment, the second end portion 56 is accessible by an operator standing along side of the cart assembly 10. The second end portion 56 includes a handle 58. In one embodiment, selective actuation of the handle 58 is adapted to provide power to the drive motor 50 for propelling the surface milling apparatus.

Figure 2:
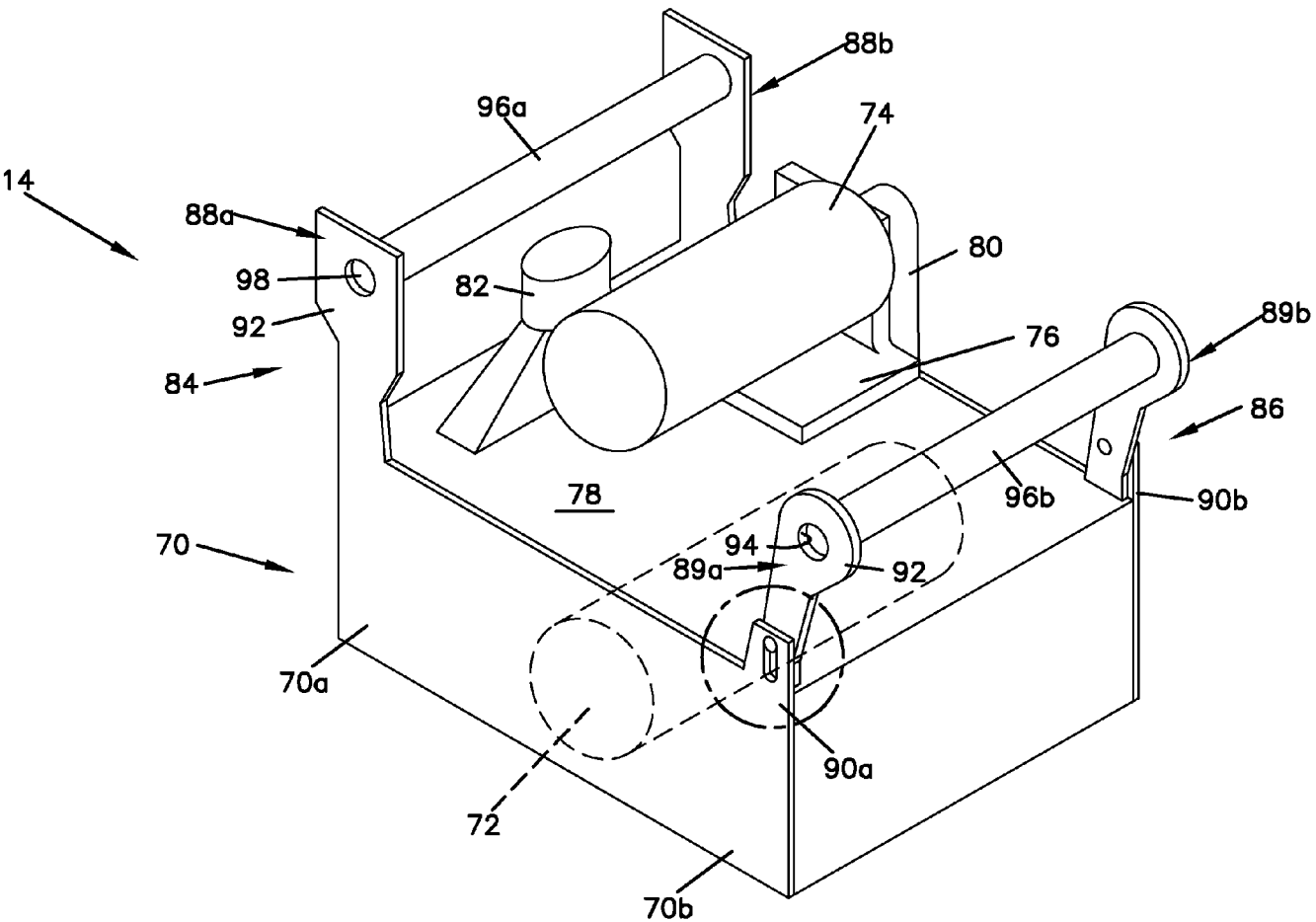
FIG. 2 is a perspective view of a milling assembly suitable for use with the cart assembly of FIG. 1.

Referring now to FIGS. 1 and 2, the milling assembly 14 is shown. The milling assembly 14 includes a support enclosure 70. The support enclosure 70 is adapted to grind/mill a surface material (e.g., concrete, stone, wood, etc.) as the cart assembly 10 is directed across that surface. The support enclosure 70 includes a first end 70*a*, an oppositely disposed second end 70*b*, and at least one grinder 72 (shown schematically by dashed lines in FIG. 2) that rotates about an axis. In one embodiment, the grinder 72 rotates about a horizontal axis (e.g., one or more grinding drums that rotate about horizontal axes). In another embodiment, the grinder 72 rotates about a vertical axis (e.g., one or more grinding discs that rotate about vertical axes). In another embodiment, the grinder 72 can oscillate or use a random orbit motion.

The grinder 72 is driven by a grinder motor 74. In the subject embodiment, the grinder motor 74 is mounted to a mounting bracket 76, which is disposed on a top surface 78 of the support enclosure 70. In the subject embodiment, the grinder motor 74 is an electric motor that is engaged with the grinder 72 through a belt/chain 80. An exemplary motor suitable for use with the grinder 72 is a high cycle motor manufactured by Diamond Tech of Rocklin, Calif. having a model number of M4-1AK.

The milling assembly 14 further includes a vacuum attachment port 82. The vacuum attachment port 82 provides a location at which a vacuum can be attached to the milling apparatus 14 so that cuttings from the grinder 72 can be collected.

In the subject embodiment, the milling assembly 14 is floatably mounted to the support frame 16. It will be understood that the term "floatably" as used in the disclosure and the appended claims means that at least one end of the milling assembly 14 is capable of moving in a generally upward direction relative to the support frame 16 without mechanical assistance during operation of the cart assembly 10.

The milling assembly 14 includes a first mount, generally designated 84, disposed adjacent to the first end 70*a* of the support enclosure 70 and a second mount, generally designated 86, disposed adjacent to the second end 70*b* of the support enclosure 70. In the subject embodiment, the first and second mounts 84, 86 are adapted to suspend the support enclosure 70 from the support frame 16 of the cart 12 of the cart assembly 10 such that the grinder 72 is disposed a given distance below the support frame 16 and thereby selectively and precisely mill off all material of a surface above a previously determined finish elevation.

The first mounts 84 includes first and second hangers 88*a*, 88*b* that extend outwardly from the top surface 78 of the support enclosure 70 in a generally perpendicular direction. In the subject embodiment, the first and second hangers 88*a*, 88*b* of the first mount 84 are integral with or rigidly connected (e.g., welded, bolted, etc.) to the support enclosure 70. The second mount 86 includes first and second hangers 89*a*, 89*b* that extend outwardly from the top surface 78 of the support enclosure 70 in a generally perpendicular direction. In the subject embodiment, the first and second hangers 89*a*, 89*b* of the second mount 86 are floatably engaged with first and second brackets 90*a*, 90*b*, respectively.

Each of the first and second mounts 84, 86 includes a mount portion 92 having an opening 94 that extends through the mount portion 92. The openings 94 in the first hangers 88*a*, 89*a* are generally aligned with the openings 94 in the second hangers 88*b*, 89*b*, respectively.

The first mount 84 further includes a mounting tube 96*a* that extends between the first and second hangers 88*a*, 88*b* while the second mount 86 further includes a mounting tube 96*b* that extends between the first and second hangers 89*a*, 89*b*. Each of the mounting tubes 96*a*, 96*b* defines a bore 98 that extends axially through the mounting tubes 96*a*, 96*b*. The bores 98 of the mounting tubes 96*a*, 96*b* are adapted to receive the mounting bars 26 such that the mounting tubes 96*a*, 96*b* of the first and second mounts 84, 86 are adapted for sliding engagement with the mounting bars 26.

The mounting tube 96*a* is engaged with the first and second hangers 88*a*, 88*b* of the first mount 84 such that the bore 98 of the mounting tube 96*a* is generally aligned with the openings 94 of the first and second hangers 88*a*, 88*b*. The mounting tube 96*b* is engaged with the first and second hangers 89*a*, 89*b* of the second mount 86 such that the bore 98 of the mounting tube 96*b* is generally aligned with the openings 94 of the first and second hangers 89*a*, 89*b*. In one embodiment, the inner diameter of each of the bores 98 is slightly larger than the outer diameter of each of the mounting bars 26. This slightly larger inner diameter allows the milling assembly 14 to be selectively moveable along the transverse axis 27 of the mounting bars 26 between the first and second sides 20, 22 of the support frame 16. This selective movement of the milling assembly 14 along the transverse axis 27 is potentially advantageous as it allows the grinder 72 to be positioned such that it is close to a wall during operation of the cart assembly 10.

Figure 3:
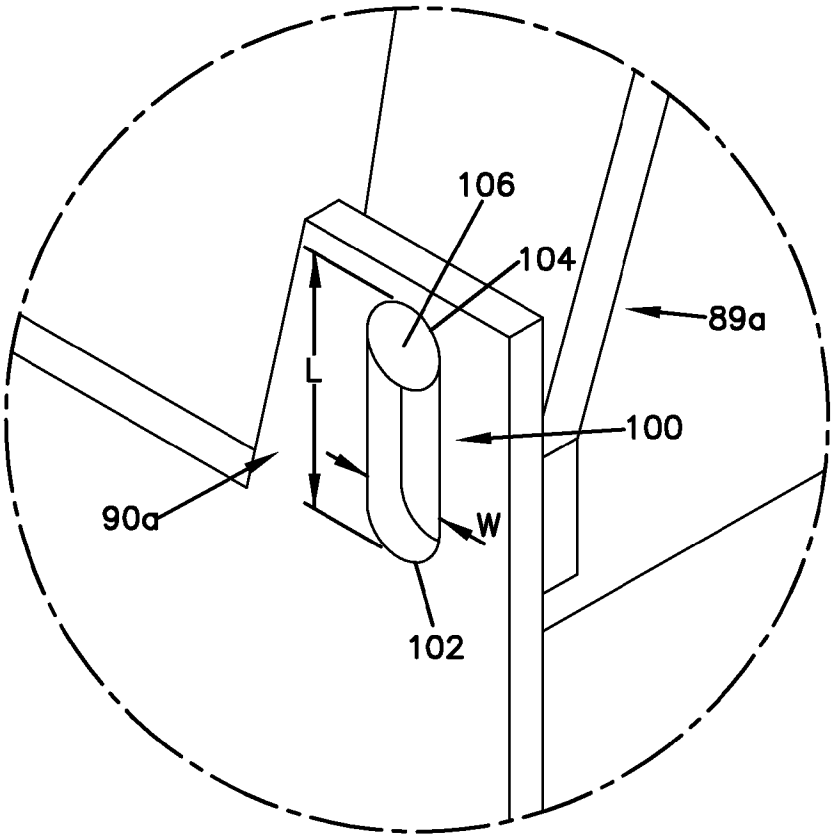
FIG. 3 is a fragmentary view of the milling assembly of FIG. 2.

Referring now to FIG. 3, the floatable engagement between the first and second hangers 89*a*, 89*b* of the second mount 86 and the first and second brackets 90*a*, 90*b* of the support enclosure 70 allow at least a portion of the support enclosure 70 to be moveable in a generally vertical direction (e.g., raised and lowered) while remaining generally parallel to the frame 16. In the depicted embodiment of FIG. 3, each of the first and second brackets 90*a*, 90*b* of the support enclosure 70 defines a slot 100 having a length L in a generally vertical direction and a width W. Each of the slots 100 includes a first end 102 and a second end 104. The slots 100 in the first and second brackets 90*a*, 90*b* are configured to receive pins 106 that are engaged to the first and second hangers 89*a*, 89*b* and to allow movement of the pins 106 between the first and second ends 102, 104 of the slots 100.

While the first and second hangers 89*a*, 89*b* of the second mount 86 are floatably engaged with the first and second brackets 90*a*, 90*b* of the support enclosure 70, the first mount is pivotally engaged with the first mounting bar 26*a*. In the depicted embodiment, as the pins 106 move between the first ends 102 and the second ends 104 of the slots 100, the first mount 84 pivots about the transverse axis 27 of the first mounting bar 26*a*.

In the depicted embodiment, the support enclosure 70 can be raised a maximum distance that is equal to the length L of the slot 100 minus the diameter of the pin 106. In one embodiment, the maximum distance the support enclosure 70 can be raised is less than or equal to about 1 inch. In another embodiment, the maximum distance the support enclosure 70 can be raised is less than or equal to about 0.5 inches.

In the normal operating mode, the support enclosure 70 is positioned in the maximum downward position (shown in FIG. 3). The weight of the support enclosure 70 is supported in the maximum downward position by the pin 106 abutting the second end 104 of the slot 100.

In the depicted embodiment, the lateral orientation (from the first side 20 to the second side 22) of the support enclosure 70 is adjustable by moving the support enclosure 70 along the transverse axis 27 of the mounting bars 26 between the first and second sides 20, 22 of the support frame 16. The vertical orientation of the support enclosure 70 relative to the surface can adjusted by raising and/or lowering the reference plane, which results in the actuators 46 being raised or lowered accordingly.

Figure 4:
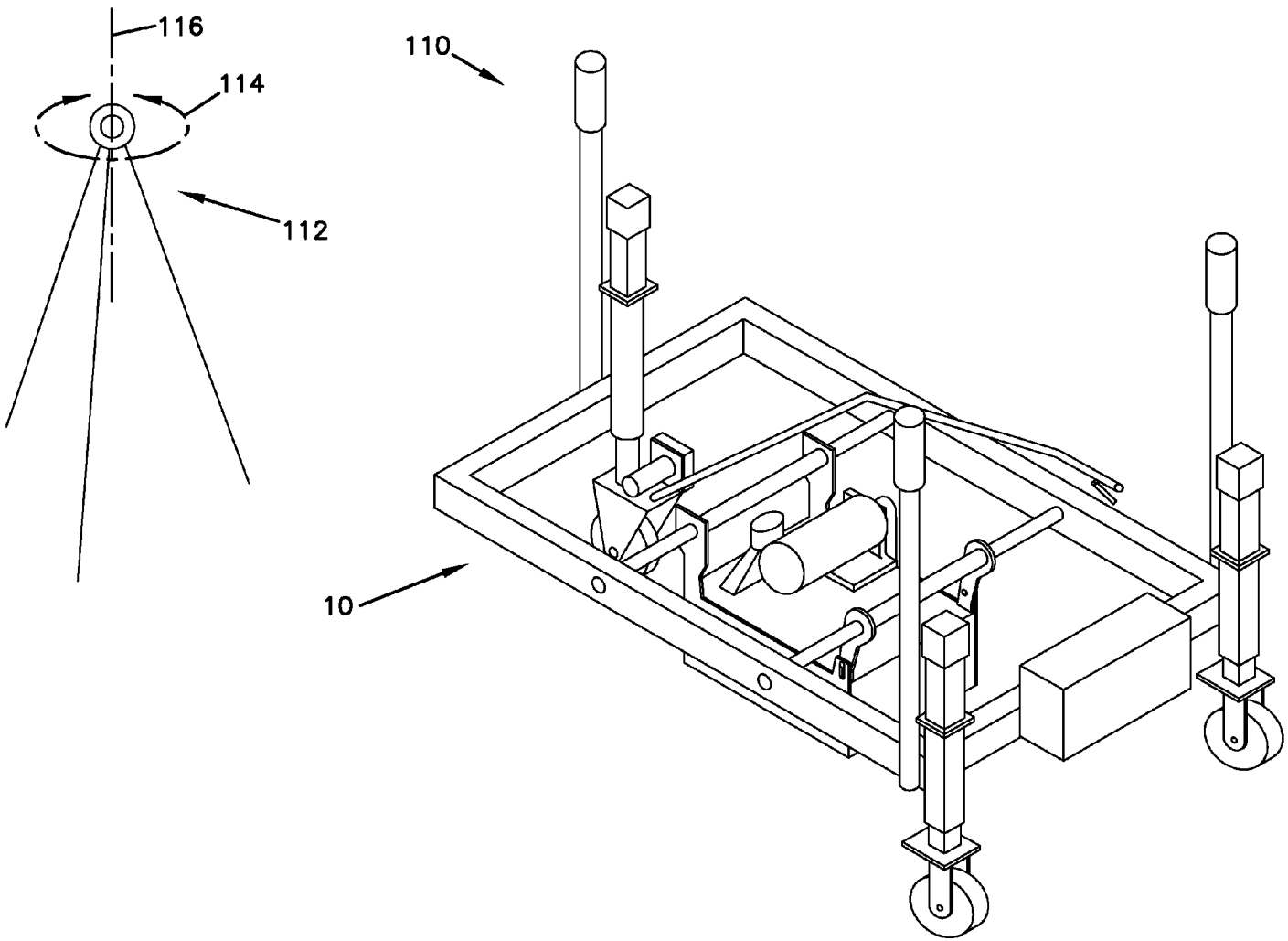
FIG. 4 is a perspective view of a surface milling system having exemplary features of aspects in accordance with the principles of the present disclosure.

Referring now to FIG. 4, a surface milling system 110 is shown. The surface milling system 110 includes the cart assembly 10 and at least one datum device 112 disposed at a location remote from the cart assembly 10.

Prior to milling or grinding the surface, the datum device 112 establishes a reference plane. The reference plane is a datum that is used as a reference by the cart assembly 10 in flattening the surface. In one embodiment, the reference plane established by the datum device 112 is level. In another embodiment, the reference plane established by the datum device 112 is sloped. In the situation where the reference plane is sloped, the cart assembly 10 can be used to remove undulations in a sloped surface.

In the subject embodiment, the datum device 112 is a laser emitting device. In one embodiment, the laser emitting device emits a laser signal that rotates in a rotational direction 114 (shown as an arrow in FIG. 4) about an axis 116 through the laser emitting device. In another embodiment, the reference plane is established by an ultrasonic emitting device. The datum device 112 is an ultrasonic emitting device. The ultrasonic emitting device emits a sonic beam that is received by the receivers 48. With the reference plane established, the receivers 48 actuate the actuators 46 such that the support frame 16 of the cart 12 is maintained parallel to the reference plane.

In one embodiment, a surface assessment is performed. The surface assessment determines the difference in elevation between high and low points in the surface. This difference in elevation is used to determine the depth of cut required to level the surface. In one embodiment, a profilograph is used to determine the difference in elevation.

With the difference in elevation of the surface determined, the location of the support enclosure 70 relative to the surface is adjusted to a desired position. The positioning of the support enclosure 70 to the desired position is effectuated by raising or lowering the reference plane provided by the datum device 112. With the reference plane raised or lowered, the wheels 30 of the wheel assemblies 28 are raised or lowered respectively such that the receivers 48 are brought to the same elevation as the newly positioned reference plane. In one embodiment, the desired position of the support enclosure 70 is adapted to remove a portion of the difference in elevation of the surface. In another embodiment, the desired position of the support enclosure 70 is adapted to remove the entire difference in elevation of the surface.

As the cart assembly 10 is directed across the surface, each of the receivers 48 selectively transmits an electrical signal to the corresponding actuator 46 in response to deviations in height between the receiver 48 and the reference plane. In response to the electrical signals from the receivers 48, the actuators extend or retract the shafts 32 of the wheel assemblies 28, which adjust the height of the support frame 16 so as to keep the receivers 48 aligned with the reference plane. This selective actuation of the shafts 32 allows the support frame 16 to remain generally parallel to the reference plane even when the support frame 16 moves across a surface of varying elevation.

While the support frame 16 is maintained generally parallel to the reference plane during operation of the cart assembly 10, at least one end of the support enclosure 70, which is floatably mounted to the support frame 16, is capable of independent movement in an upward direction relative to the support frame 16. This independent movement of the support enclosure 70 allows for movement of the support enclosure 70 without disrupting the height or slope of the support frame 16. This generally upward movement allows the support enclosure 70 to lift in the event the cutter 72 encounters a portion of the surface having a relatively high spot of material that would require the cutter 72 to remove excessive material for a given travel speed or if an excessively hard section of material in the surface was encountered such as embedded steel. By allowing the support enclosure 70 to lift relative to the support frame 16 during such an event, the support enclosure 70 of the cart assembly 10 avoids potential damage resulting from the removal of too much material for a given travel speed. In addition, the height and/or slope of the support frame 16 remains constant such that in the event described above, the cart assembly 10 can be directed over that portion of the surface again without having to adjust the height of the support frame 16 to account for the high spot.

In one aspect of the present disclosure, after the cart assembly 10 finishes grinding the surface, a diamond polisher is utilized. The diamond polisher is utilized to polish the surface to a desired finish. In one aspect of the present disclosure, the diamond polisher provides a glossy finish.

Figure 5:
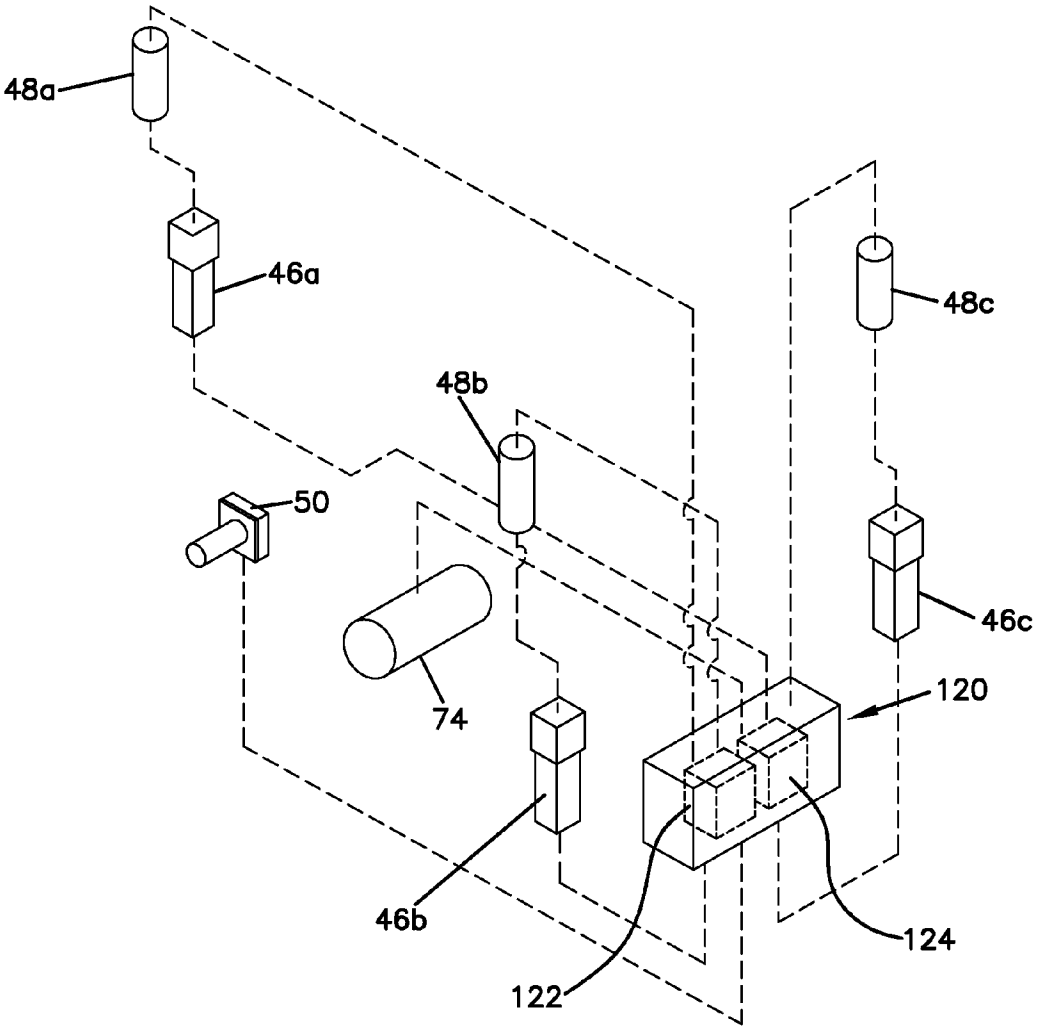
FIG. 5 is an exemplary schematic of a control scheme for controlling the cart assembly of FIG. 1.

Referring now to FIGS. 1 and 5, an exemplary control method of the cart assembly 10 will be described. The cart assembly 10 includes a controller 120. In the depicted embodiment of FIG. 1, the controller 120 is disposed on the second cross support 25 of the support frame 16.

The controller 120 is in data/signal transmitting communication with the drive motor 50, the grinder motor 74, the actuators 46 and the receivers 48. In one embodiment, when the cart assembly 10 is operational, the controller 120 adjusts the power to the drive motor 50 in response to power provided to the grinding motor 74. This power adjustment to the drive motor 50 allows the grinding motor 74 to operate at constant torque conditions. For example, if the torque output of the grinding motor 74 is high due to a large amount of material being removed, the controller 120 may reduce the power to the drive motor 50 to decrease the travel speed of the cart assembly 10 to maintain the torque of the grinding motor 74 at a desired value. If the torque output of the grinding motor 74 is low, the controller 120 may increase the power provided to the drive motor 50 to increase the travel speed.

In one embodiment, the controller 120 includes an inverter 122 for providing high-cycle power to the drive motor 50 and the grinding motor 74. This high-cycle power allows for the drive motor 50 and the grinding motor 74 to be very compact yet provide high power output (i.e., high-power density devices). In one embodiment, and by way of example only, the inverter 122 provides high-cycle power up to 400 cycles/second. An exemplary inverter 122 suitable for use with the controller 120 is the 460V, 34 Amp Variable Frequency Drive manufactured by Diamond Tech of Rocklin, Calif. having a model number of I4-1AK.

In a preferred embodiment, the controller 120 includes a load-sensing device 124 that monitors the torque output of the grinding motor 74. In response to information from the load-sensing device, the controller 120 adjusts the power provided to the drive motor 50 in order to maintain a generally constant torque output from the grinding motor 74.

In an alternate embodiment, the controller 120 provides constant power to the drive motor 50 and the grinding motor 74. In this embodiment, power is supplied to the drive motor 50 and the grinding motor 74 regardless of the torque output from the grinding motor 74.

The cart assembly 10 is potentially advantageous since the support frame 16 is maintained at a fixed elevation while only the wheels 30 of the wheel assemblies 28 follow the contour of the surface. In addition, the support enclosure 70 of the milling assembly 14 is free to lift up under heavy grinding conditions without disturbing the elevation of the support frame 16.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. A surface milling system comprising:

a datum device for generating a reference plane;

a support frame;

a grinder supported by the support frame;

at least first, second and third wheels on which the support frame is supported;

at least first, second and third actuators for raising and lowering the first, second and third wheels relative to the support frame, the first actuator being adapted to raise and lower the first wheel, the second actuator being adapted to raise and lower the second wheel and the third actuator being adapted to raise and lower the third wheel;

a first receiver corresponding to the first actuator for detecting the reference plane;

a second receiver corresponding to the second actuator for detecting the reference plane;

a third receiver corresponding to the third actuator for detecting the reference plane; and wherein data from the first, second and third receivers is used to control the first, second and third actuators such that the support frame is maintained at a constant position relative to the reference plane even when the support frame moves across a surface of varying elevation, wherein the datum device is not carried by the support frame such that the support frame is movable with respect to the datum device.

2. The surface milling system of claim 1, wherein at least one end of the grinder is moveable upwardly and downwardly relative to the support frame.

3. The surface milling system of claim 2, wherein the grinder maintains a constant surface grinding plane angle relative to the support frame when the grinder moves upwardly and downwardly relative to the support frame.

4. The surface milling system of claim 1 wherein the datum device is a laser emitting device.

5. The surface milling system of claim 1, wherein the grinder is suspended from the support frame.

6. The surface milling system of claim 1, wherein the grinder is part of a milling assembly mounted to the support frame, wherein at least one end of the milling assembly is floatably mounted to the support frame.

7. The surface milling system of claim 6, wherein the milling assembly includes a plurality of mounts for mounting the milling assembly to the support frame with at least one of the mounts being adapted to allow the milling assembly to move in an upward direction relative to the support frame.

8. The surface milling system of claim 7, wherein the at least one mount is a hanger engaged to the support frame, the hanger having a slot adapted to receive a pin engaged to the milling assembly.

9. The surface milling system of claim 1, wherein each of the first, second, and third receivers is disposed on the support frame adjacent to its corresponding wheel and actuator.

10. The surface milling system of claim 1, wherein the support frame defines a longitudinal axis and a transverse axis that is generally perpendicular to the longitudinal axis and wherein the grinder is selectively moveable along the transverse axis of the support frame.

11. The surface milling system of claim 1, further including a drive motor engaged to one of the wheels, wherein the drive motor is adapted to propel the support frame.

12. The surface milling system of claim 1, wherein a controller disposed on the support frame provides power to the drive motor and a grinder motor that is engaged with the grinder.

13. The surface milling system of claim 12, wherein the controller is configured to adjust power provided to the drive motor to maintain a generally constant torque output from the grinder motor.

14. The surface milling system of claim 12, wherein the controller includes an inverter.

15. The surface milling system of claim 12, wherein the controller includes a load sensing device for monitoring the torque output of the grinder motor.

16. The surface milling system of claim 1, further including a tiller arm engaged to one of the wheels.

17. The surface milling system of claim 1, further including a vacuum port for collecting cuttings from the grinder.

18. The surface milling system of claim 1, wherein the generated reference plane is initially elevated with respect to the first, second, and third receivers such that the first, second, and third receivers each selectively transmits a signal to the corresponding actuator in response to deviations in height between the receiver and the reference plane.

19. The surface milling system of claim 1, wherein the generated reference plane is level.

20. The surface milling system of claim 1, wherein the generated reference plane is sloped.

* * * * *